US007677140B2

(12) United States Patent
Hull et al.

(10) Patent No.: US 7,677,140 B2
(45) Date of Patent: Mar. 16, 2010

(54) TOOL HAVING A TELESCOPING HANDLE

(76) Inventors: Ricky Eugene Hull, 686 S. Sandusky St., Lot #113, Tiffin, OH (US) 44883; Steve Batdorff, 21154 Mayapple Pl., Sterling, VA (US) 20164

( * ) Notice: Subject to any disclaimer, the term of this patent is extended or adjusted under 35 U.S.C. 154(b) by 496 days.

(21) Appl. No.: 11/636,990

(22) Filed: Dec. 12, 2006

(65) Prior Publication Data

US 2007/0131070 A1 Jun. 14, 2007

Related U.S. Application Data

(60) Provisional application No. 60/750,280, filed on Dec. 14, 2005.

(51) Int. Cl.
*B25B 23/16* (2006.01)
*B25G 1/04* (2006.01)

(52) U.S. Cl. ..... 81/177.2; 16/429; 403/109.3; 403/377

(58) Field of Classification Search ..... 81/489, 81/177.2, 177.1, 184, 185.2; 403/109.1, 403/109.2, 109.3, 107, 108, 377, 328, 109.5; 16/429

See application file for complete search history.

(56) References Cited

U.S. PATENT DOCUMENTS

| | | | | |
|---|---|---|---|---|
| 1,398,455 | A | 11/1921 | De Clairmont | |
| 2,334,057 | A | 11/1943 | Ashton et al. | |
| 2,438,633 | A * | 3/1948 | Condor | 81/177.2 |
| 2,963,930 | A | 12/1960 | Clothier et al. | |
| 3,579,894 | A | 5/1971 | Kidder | |
| 3,873,143 | A | 3/1975 | Foust | |
| 4,581,958 | A | 4/1986 | Shull | |
| 4,586,406 | A | 5/1986 | Howard | |
| 5,109,737 | A * | 5/1992 | Raber | 81/177.2 |
| 5,471,899 | A | 12/1995 | Twomlow | |
| 6,301,987 | B1 | 10/2001 | Chakri et al. | |
| 6,339,979 | B1 | 1/2002 | Chiang | |
| 6,408,721 | B1 | 6/2002 | Lee | |
| 6,532,846 | B2 | 3/2003 | Lin | |
| 6,761,094 | B2 | 7/2004 | Tobako | |
| 7,000,497 | B1 | 2/2006 | Campbell et al. | |
| 7,093,521 | B2 | 8/2006 | Lee | |
| 7,434,495 | B2 * | 10/2008 | Lin | 81/177.2 |
| 2004/0020331 | A1 | 2/2004 | Lee | |

FOREIGN PATENT DOCUMENTS

| | | |
|---|---|---|
| TW | 466995 | 12/2001 |

* cited by examiner

*Primary Examiner*—Hadi Shakeri
(74) *Attorney, Agent, or Firm*—Bacon & Thomas, PLLC

(57) ABSTRACT

A tool having a telescoping handle including a main shank and an outer sleeve complementary shaped to receive the main shank therein. A guide groove is formed in an outer circumferential surface of the main shank for receiving a guide pin formed or attached to an inner circumferential surface of the outer sleeve. A locking collar may be provided to cause a bearing member to selectively engage locking structures formed on the main shank in order to selectively lock the telescoping handle in selected positions. The bearing member may also serve as the guide pin. Alternatively, at least two distinct locking and release mechanisms may be provided to selectively lock the telescoping handle in selected positions.

5 Claims, 10 Drawing Sheets

216
258

252
250
256
254
240
224
228
226
226
228
218
216
240
212

228
226
226
228
232
236
234
234
260
232

224
222

256
252
254
240
224
238
228
268
236
264
260
266
232
240
212

TOOL HAVING A TELESCOPING HANDLE

This application claims the benefit of U.S. Provisional Application No. 60/750,280, filed Dec. 14, 2005.

FIELD OF THE INVENTION

The present invention relates generally to the field of telescoping handles and more particularly to the field of tools having telescoping handles.

BACKGROUND

Tools and levers that are used to apply torque and leverage to work pieces, such as nuts, bolts, winches, cranks, or transmission gear selectors, are typically designed to have a constant length handle, and therefore to apply the same amount of torque or leverage to the work piece, regardless of the size of the workpiece. This limitation is especially prevalent in the use of tools having standard or non-standard sized socket heads, such as ¼", ⅜", ½", ¾", 1", or greater, which allow a user to use numerous different sized sockets to tighten or loosen different sized work pieces. This limitation also arises in the use of adjustable head wrenches, such as pipe wrenches and crescent wrenches, where a user is using the same wrench to apply torque or leverage to different sized work pieces. The constant length handle does not allow for greater or lesser torque to be applied when the tool is used to tighten or loosen larger or smaller work pieces.

The limitation of a constant length handle also arises in other situations where it is desirable to be able to apply different amounts of torque to a workpiece, such as when the workpiece has been frozen in place due to corrosion.

Another situation where a constant length handle is a detriment is when it is desirable to reduce the length of the handle when the handle is not actually being used to apply a torque, such as the situation of a transmission shift lever, where a long shift lever may interfere with movement within the cab of a vehicle or provide an obstacle to adjusting instruments within the cab of the vehicle.

Further, a tool with a long, stationary handle, which provides more available leverage or torque than a tool with a smaller handle, may not fit into a commonly available toolbox or stowage compartment in a vehicle with limited storage space such as a military tank. A tool with a telescoping handle provides the option of stowing the tool into smaller containers or compartments.

For these and other reasons it is desirable to provide a telescoping handle for use with tools, fore example, ratchet wrenches, adjustable wrenches, crescent wrenches, open end wrenches, box wrenches, pipe wrenches, winches or windlasses, capstans, cranks, and transmission shift levers.

SUMMARY

In order to provide a handle for use with tools that is capable of applying different amounts of torque or leverage to the same or different work pieces, different embodiments of an inventive telescoping handle are provided.

In a first embodiment, a tool having a telescoping handle comprises a main shank including a distal operational end, a proximal end, and an outer circumferential surface along the shank between the distal end and the proximal end. An axial guide groove may be formed in the outer circumferential surface of the shank and may extend along a portion of the shank from the distal end towards the proximal end and may include including at least one terminal guide stop at an end thereof. At least one locking structure may be formed in the circumferential surface of the shank in order to prevent extension or shortening of the telescoping handle.

An outer sleeve having distal and proximal ends may be mounted telescopically to the main shank. The sleeve may include an outer circumferential surface having two axially spaced distal and proximal circumferential grooves located near the distal end for retaining corresponding snap rings. The outer circumferential surface may have an uniform outer circumference outside the distal and proximal grooves. The outer sleeve includes a bore defined by an inner circumferential surface and extending from the distal end of the sleeve. The bore may be sized and configured to matingly engage the outer circumferential surface of the shank.

The outer sleeve may further include at least one clearance hole located between the distal and proximal grooves and extending through the outer sleeve from the outer circumferential surface to the inner circumferential surface. A bearing member may be positioned within the clearance hole for selectively engaging the locking structure. A spring member may be positioned on the outer sleeve between the distal and proximal grooves such that the proximal end of the spring member engages the proximal snap ring.

An annular locking collar may be positioned along the outer sleeve between the distal and proximal grooves. The collar may include distal and proximal inner circumferential surfaces separated at distal and proximal right angles by a circumferential bearing member engaging surface that is configured to selectively engage the bearing member. Thus the distal right angle portion may define a distal snap ring engaging surface for selectively engaging the distal snap ring and the proximal right angle portion may define a spring member engaging surface for engaging the spring member. In this manner the spring member may be retained in the space defined between the proximal snap ring, the outer circumferential surface of the sleeve, the spring member engaging surface, and the proximal inner circumferential surface of the annular locking collar.

In use, the annular locking collar may be axially displaceable such that when the distal snap ring engaging surface of the annular locking collar is in engagement with the distal snap ring, the bearing member engaging surface engages the bearing member in order to lock the bearing member in engagement with the locking structure to prevent extension or shortening of the telescoping handle, and such that when the bearing member engaging surface of the annular locking collar does not engage the bearing member, the telescoping handle may be extended or shortened.

In another embodiment, the outer sleeve may be open at both ends and may include a guide pin located along a distal region of the inner circumferential surface, that is configured to be received within and to engage the guide groove and the guide groove may extend to the proximal end of the main shank to allow the outer sleeve to be positioned on the main shank; and a retaining assembly configured to maintain the outer sleeve in position on the main shank may be provided.

In another embodiment, the retaining assembly may include a distal retaining washer and a proximal retaining washer each having a bore and an outer circumference matching the outer circumference of the main shank and a threaded screw or bolt passing through the bores of the retaining washers and threadingly engaging a threaded hole in the proximal end of the main shank such that the guide pin is retained in the guide groove by the distal retaining washer.

In another embodiment, the distal retaining washer may be constructed from a softer material than the proximal retaining washer.

In another embodiment, the distal operational head may define a tool head.

In another embodiment, the locking structure may include at least two axially spaced circumferential grooves in the outer circumference of the main shank.

In another embodiment, the guide groove may include axially spaced distal and proximal guide stops located at distal and proximal terminal ends of the guide groove, and the locking structure may include at least two axially spaced detents formed within the guide groove.

In another embodiment, the detents may be located at the distal and proximal ends of the guide groove and may form the distal and proximal guide stops.

In another embodiment, the main shank may include a radial bore for receiving a spring member and a bearing member, such that the bearing member is biased radially away from the main shank, so that when the outer sleeve is placed upon the main shank, the bearing member engages the inner circumferential surface of the outer sleeve.

In another embodiment, the telescoping handle may include an ergonomic grip portion that is affixed to the proximal end of the outer sleeve, the locking collar may include finger grips, and the distal operational end of the main shank may include a base configured for connection to a gear shifting mechanism.

In another embodiment, the distal operational end of the main shank may define a first tool head, and the proximal end of the outer sleeve may define a second tool head.

In another embodiment, the shape of the outer circumferential surface of the main shank and the shape of the inner circumferential surface of the outer sleeve may be selected from the group consisting of a circle, a triangle, a quadrilateral, a hexagon, and any N-sided shape, where N is an integer.

In another embodiment, the locking collar may include a knurled portion and indicia indicating the direction to axially displace the locking collar in order to release the bearing member from engagement with the locking structure in order to extend or shorten the telescoping handle.

In another embodiment, the telescoping handle may include an ergonomic grip affixed to the proximal end of the outer sleeve and having a hole passing therethrough configured for hanging the telescoping handle.

In another embodiment, a tool having a telescoping handle may include a main shank defining a distal operational end, a proximal end, and an outer circumferential surface along the shank between the distal end and the proximal end. An axial guide groove may be formed in the outer circumferential surface of the main shank and may extend along a portion of the shank from the distal end towards the proximal end. The guide groove may include at least one terminal guide stop at an end thereof. The shank may have at least one first locking structure formed in the circumferential surface of the main shank and a second locking structure formed in the distal end of the main shank.

An outer sleeve may be mounted telescopically to the main shank and may have distal and proximal ends, and an outer circumferential surface. The sleeve may also have a bore extending from the distal end thereof that may be defined by an inner circumferential surface that may be sized and configured to matingly engage the outer circumferential surface of the main shank. The sleeve may also include a guide pin on the inner circumferential surface for engaging the guide groove, and at least one clearance hole positioned near the distal end and configured to engage the first locking structure to prevent extension or shortening of the telescoping handle. A release mechanism may be carried by the proximal end of the outer sleeve and may be configured to engage the second locking structure to prevent extension or shortening of the telescoping handle.

In another embodiment, the first locking structure may include a radial bore formed near the proximal end of the main shank, a spring member positioned within the bore; and a locking button positioned within the bore and biased radially away from the main shank by the spring member, such that when the outer sleeve is placed upon the main shank, the locking button engages the inner circumferential surface of the outer sleeve, or the locking button engages the clearance hole to prevent extension or shortening of the telescoping handle.

In another embodiment, the axial guide groove may extend to the proximal end of the main shank to allow the outer sleeve to be positioned on the main shank.

In another embodiment, the axial guide groove may extend from a position near the distal end of the main shank to a position near the proximal end of the main shank and may intersect a partial circumferential connecting channel that extends circumferentially around a portion of the main shank; and the partial circumferential connecting channel may intersect an axial dismantling channel that extends to the proximal end of the main shank, such that when the outer sleeve is received on the main shank the guide pin respectively engages the axial dismantling channel, the partial circumferential connecting channel, and the axial guide groove.

In another embodiment, the release mechanism may include a button portion having pressing surface, and an extending shank with a spring member received on the extending shank for biasing the pressing surface in an unactuacted position and a grooved portion formed in the extending shank for receiving a bearing member; and a retaining portion having a stepped axial bore therethrough to receive the extending shank and define an engaging surface for the spring member, a radial hole through which a portion of the bearing member extends to selectively engage the second locking structure, and a threaded hole for receiving a threaded screw that engages a second hole in the outer sleeve portion such that the release mechanism is retained in the proximal end of the outer sleeve.

In a further embodiment, the annular locking collar may have distal and proximal smooth inner circumferential surfaces separated at distal and proximal right angles by a circumferential bearing member engaging surface.

One of the advantages of the telescoping handle is the ability to apply different amounts of torque or leverage to a workpiece in a controlled manner. Another advantage is the ability to reduce the length of the telescoping handle when the tool is not in use, or needs to be stored in a restricted storage space.

These and other advantages of the tool having a telescoping handle will become readily apparent and better understood in view of the following description, appended claims, and accompanying drawings.

Figures 1A, 1B, 1C, 1D, 1E:
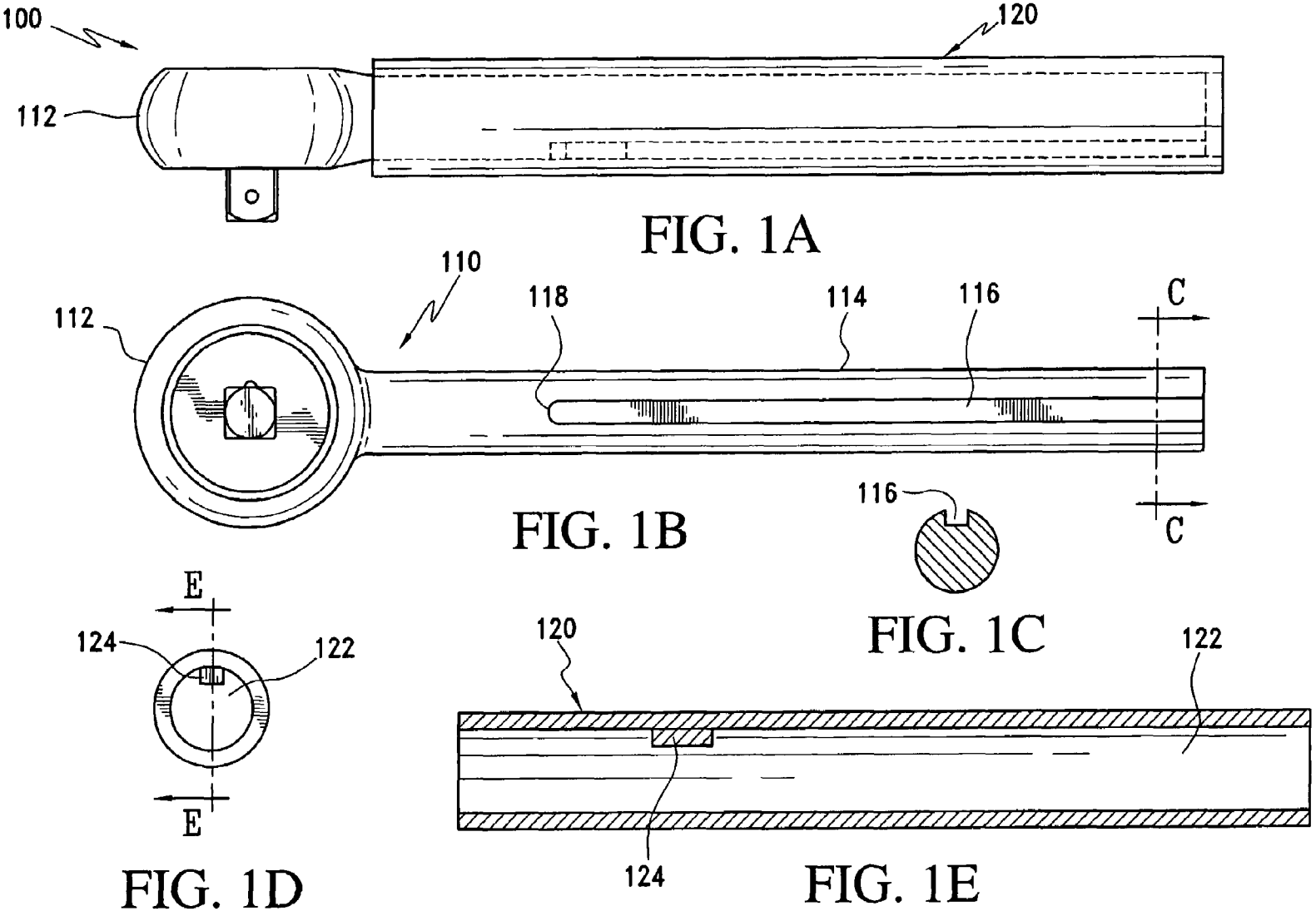
FIG. 1A is a side elevation view of an embodiment of a telescoping handle in combination with a tool head.
FIG. 1B is a bottom view of the main shank of the embodiment of FIG. 1A.
FIG. 1C is a cross-sectional view of the main shank taken along line C-C in FIG. 1B.
FIG. 1D is an end view of the outer sleeve of the embodiment of FIG. 1A.
FIG. 1E is a cross-sectional view of the outer sleeve taken along line E-Ein FIG. 1D.

It is noted that the drawing figures are not necessarily drawn to scale, but instead are drawn to provide a better understanding of the illustrated features and components thereof. In particular, the location of the numerous components and features are generalized for ease of understanding.

DETAILED DESCRIPTION OF VARIOUS EMBODIMENTS

A. Environment and Context of the Various Embodiments

The telescoping handles in accordance with this description are designed for implementation in connection with conventional tool heads, winches or windlasses, capstans, cranks, and transmissions. For example, the following description describes embodiments of a telescoping handle in combination with several tool heads, such as socket heads, breaker or pry bar heads, hole aligning heads, or heads for connection to a gear shifting mechanism. However, the telescoping handle disclosed herein is not limited to these particular embodiments, but instead may be used with any number of tool heads.

For example, the socket heads used may be any standard or non-standard socket sizes, including ¼", ⅜", ½", ¾", 1", or greater, socket heads. Further, different tool heads, such as pivoting ratchet heads, open or box end wrenches, a sliding "T" handle, an adjustable wrench head or any other appropriate tool where a telescoping handle would be beneficial may be used. Further, while not illustrated, the ratchet head may also include a standard selection switch to reverse the direction of rotation of the ratchet head, as is known to a skilled artisan. Exemplary switches and types of ratchet heads are disclosed in U.S. Pat. No. 5,471,899, granted Dec. 5, 1995, U.S. Pat. No. 4,586,406, granted May 6, 1986, and U.S. Pat. No. 6,761,094, granted Jul. 13, 2004, all incorporated herein by reference.

Additionally, while specific shapes for a telescoping handle are shown in the illustrated Figures, the circumferential shapes of the portions of the telescoping handle may be any desired shape, from circles, squares, rectangles, triangles, and hexagons to any N-sided shape, where N is an integer.

As used herein, the terms "distal" and "proximal" have their ordinary meanings and are defined in reference to the operational end of the main shank being the distal end.

B. Detailed Description of a First Embodiment

A first embodiment of a telescoping handle incorporated with a tool head is disclosed in FIGS. 1A-E. In accordance with this embodiment, a tool 100 includes a main shank 114 having a tool assembly 110 located at one end. The tool assembly 110 may include a tool head portion 112 such as a ratchet head of the type previously discussed, or any other suitable tool head. The end of the main shank 114 that has the tool head portion located thereon is defined as the distal end of the main shank 114. The opposing end of the main shank 114 is defined as the proximal end.

As best seen in FIG. 1B, the main shank 114 includes an outer circumferential surface in which a guide groove 116 is formed that extends from a position near the distal end of the main shank 114 to the proximal end of the main shank 114. The guide groove 116 may include a terminal guide stop 118 at the distal end of the guide groove 116 for limiting the axial movement of an outer sleeve 120 of the telescoping handle. The guide groove 116 may be formed in any suitable manner, such as milling by machine tools, or casting or forging integrally with the main shank 114.

As best seen in FIG. 1E, the outer sleeve 120 has a bore 122, defined by an inner circumferential surface, for receiving the main shank 114 of the telescoping handle in a clearance fit. The outer sleeve 120 also carries a guide pin 124 for being received in the guide groove 116.

In use, due to the clearance fit between the main shaft 114 and the outer sleeve 120, the outer sleeve 120 is axially movable along the main shank 114 in order to provide different amounts of torque or leverage to work pieces (not shown). The guide pin 124 allows the outer sleeve 120 to move axially, while limiting the amount that the outer sleeve 120 rotates around the main shank 114 so that there is little to no rotational slack or play between the outer sleeve 120 and the main shaft 114.

While a rectangular shaped guide pin 124 is shown in FIGS. 1D and 1E, any suitable shape may be provided, such as a square or rounded peg, a key or a floating ball bearing, or any other suitable shape, as will be apparent to a skilled artisan. Further, the guide pin 124 may be formed and attached to the inner circumferential surface of the outer sleeve 120 in any suitable manner, such as a guide pin 124 that is welded to a receptacle in the inner circumferential surface of the outer sleeve 120. Alternatively, the guide pin 124 may be in the form of a screw or post that passes from the outer circumferential surface of the outer sleeve 120 to the inner circumferential surface of the outer sleeve 120. Further, the guide pin 124 may be a floating ball bearing that runs in the guide groove 116. Still further, the guide pin may be formed by indenting the outer surface of the outer sleeve 120 to provide an extending portion on the inner circumferential surface of the sleeve 120.

Further, while the guide groove 116 is shown as a rectangular guide groove in FIGS. 1B and 1C, any suitably shaped guide groove 116 may be used such that the shape of the guide groove 116 is complementary to the shape of the guide pin 124, so that the guide pin 124 is free to slide axially within the guide groove 116, but has limited or no side to side movement, so as to limit the rotational movement between the outer sleeve 120 and the main shank 114. For example, the guide pin 124 may be a key that fits within the guide groove 116, which is a complementary shaped keyway, as will be recognized by a skilled artisan.

Additionally, the guide pin 124 and guide groove 116 may have any suitable size and shape, such as the length, width and depth of both the guide pin 124 and the guide groove 116, as determined by the size of the tool, such that the main shank 114 and the outer sleeve 120 may be locked against rotating relative to one another, and such that the force applied to the outer sleeve 120 may be transferred to the main shank 114, and hence the tool head 112, without causing damage or breakage to the guide pin 124 or guide groove 116. Such sizing may be accomplished by a skilled artisan.

The main shank 114 and the outer sleeve 120 may be made from any suitable material, for example tool steel. Of course, other suitable materials may be used, such as plastic, aluminum, and other metals, where appropriate.

As seen in FIG. 1A, the outer circumferential shape of the main shank 114 and the inner circumferential shape of the outer sleeve 120 are complementary sized and shaped. A clearance space exists between the outer circumferential surface of the main shank 114 and the inner circumferential surface of the outer sleeve 120, such that the outer sleeve 120 may freely move in the axial direction, but may have little to no rotational movement about the distal and proximal ends. Additionally, with the exception of the guide groove 116 and the guide pin 124, the outer circumferential surface of the main shank 114 and the inner circumferential surface of the outer sleeve 120 have a constant size and shape. While, as illustrated, each circumferential shape is circular, any suitable shape, such as those illustrated in FIGS. 8A-E or discussed above, may be used.

C. Detailed Description of a Second Embodiment

Figure 2A:
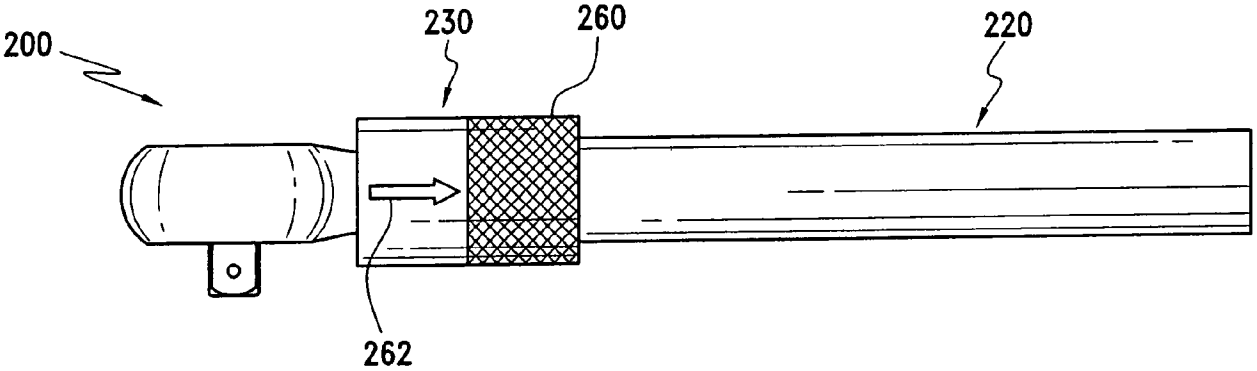
FIG. 2A is a side elevation view of an embodiment of a telescoping handle, in combination with a tool head, in a locked and unextended position.
Figure 2B:
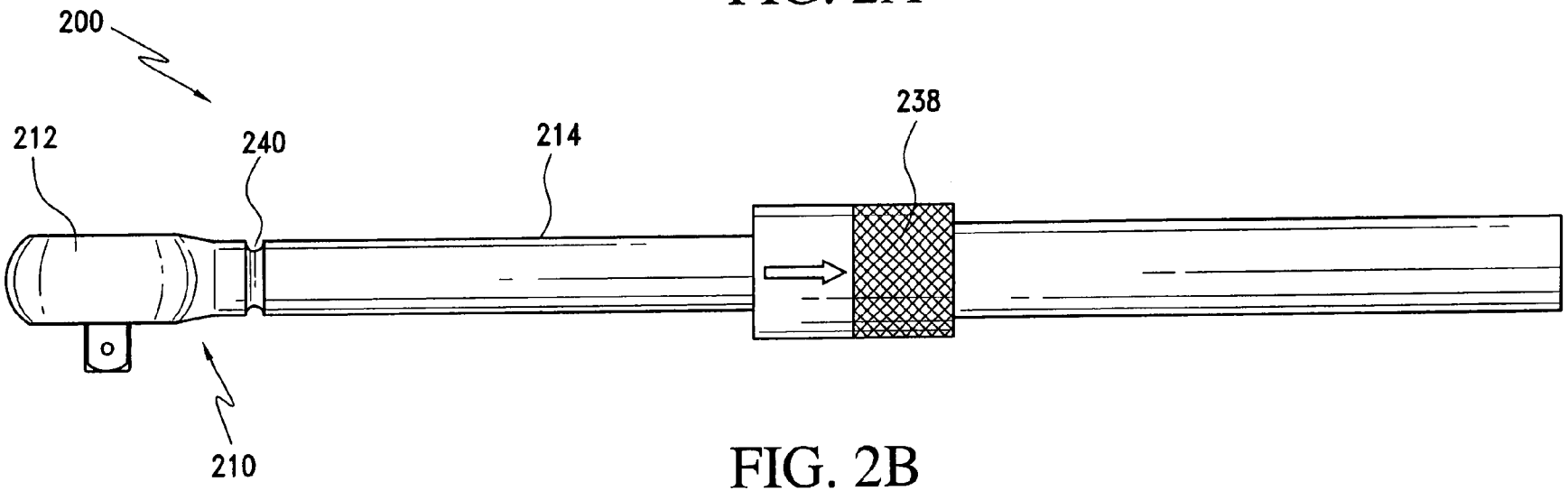
FIG. 2B is a side elevational view of the embodiment of FIG. 2A in an extended position.
Figures 2C, 2D, 2E, 2F, 2G:
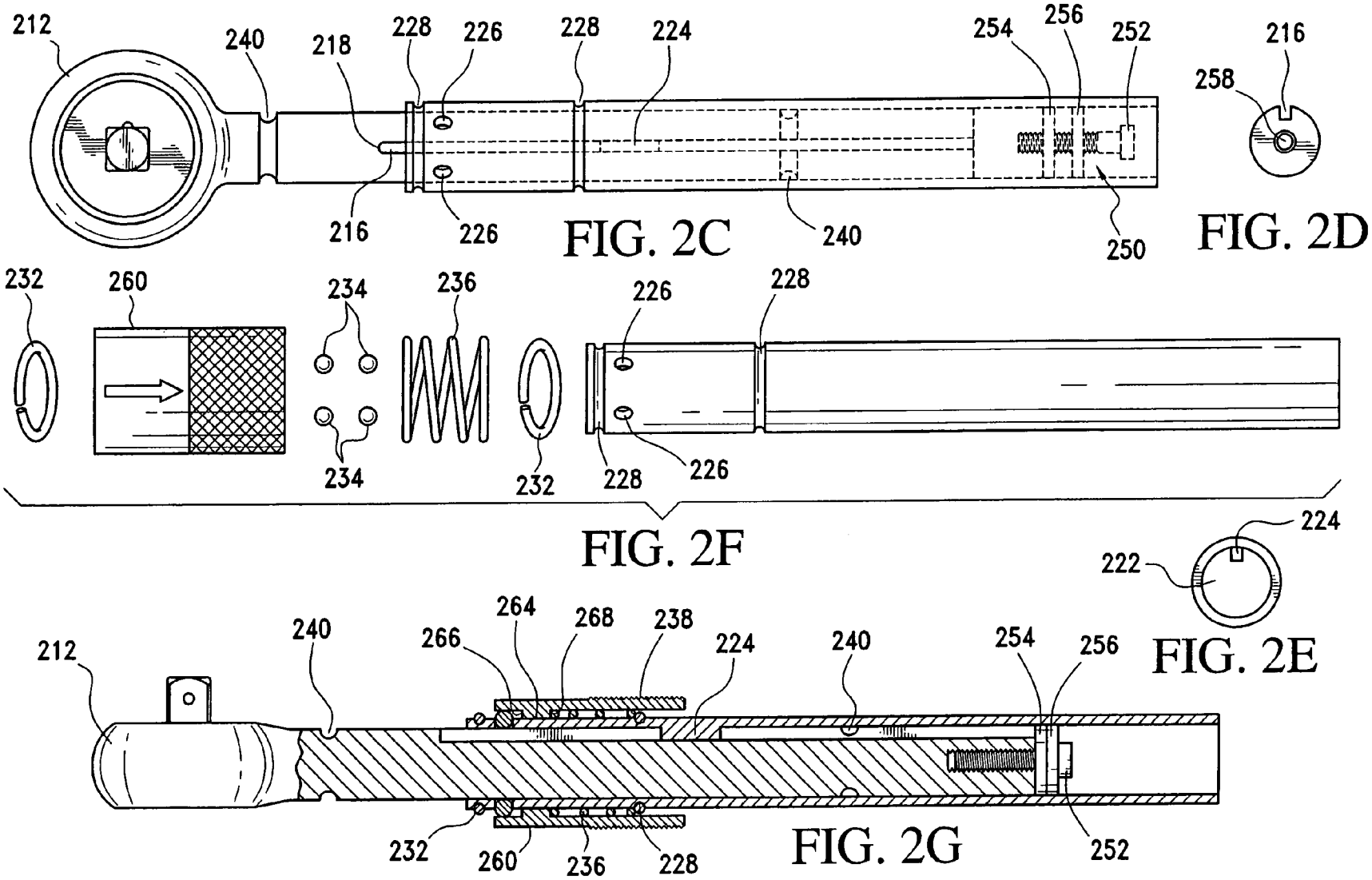
FIG. 2C is a bottom view of the embodiment of FIG. 2A in partial assembly.
FIG. 2D is an end view of the main shank of the embodiment of FIG. 2A.
FIG. 2E is an end view of the outer sleeve of the embodiment of FIG. 2A.
FIG. 2F is an exploded view of the annular locking collar and the outer sleeve of the embodiment of FIG. 2A.
FIG. 2G is a partial cross-sectional view of the embodiment of FIG. 2A showing the telescoping handle in an unlocked position.

A second embodiment of a telescoping handle incorporated with a tool head is disclosed in FIGS. 2A-G. In accordance with this embodiment, a tool 200 includes a main shank 214 having a tool assembly 210 located at one end. The tool assembly 210 may include a tool head portion 212 such as a ratchet head of the type previously discussed, or any other suitable tool head. The end of the main shank 214 that has the tool head portion located thereon is defined as the distal end of the main shank 214. The opposing end of the main shank 214 is defined as the proximal end. In this embodiment, the proximal end of the main shank 214, as shown in FIG. 2D, may include a threaded bore 258 to receive a retaining assembly 250 as will be further discussed below.

The outer circumferential surface of the main shank 214 includes a guide groove 216 having a distal terminal guide stop 218. The guide groove 216 of this embodiment may have similar characteristics as the guide groove 116 of the first embodiment, and may be formed in the same manner.

The outer circumferential surface of the main shank 214 also includes locking mechanisms in the shape of circumferential grooves 240. As illustrated, two position locking grooves 240 are shown, one near the distal end of the main shank 214 and the other near the proximal end of the main shank 214. However, any number of grooves 240, including a single groove, may be implemented. The number of grooves 240 used is the number of distinct locked positions for the telescoping handle, as will be discussed in more detail below.

In this embodiment, as best seen in FIGS. 2C and 2F, the telescoping handle includes an outer sleeve 220 that has distal and proximal ends and a bore 222 running therethrough that is defined by an inner circumferential surface. The outer sleeve 220 includes two axially spaced snap ring retaining circumferential grooves 228 located near the distal end of the outer sleeve 220.

The outer sleeve 220 also includes a guide pin 224, of the type previously discussed, and a number of clearance holes 226 for receiving bearing members 234 therein. Snap or retainer rings 232 are positioned within the grooves 228 in order to retain a locking and release collar assembly 230 in position on the outer sleeve 220. A spring member 236 is received on the outer sleeve 220 between the proximal snap ring 232 and the locking and release collar assembly 230 in order to bias the annular locking collar towards the distal end of the outer sleeve 220. As will be discussed further below, this position of the annular locking collar allows the outer sleeve 220 to be axially locked with respect to the main shank 214.

The locking and release collar assembly 230 may include an annular locking collar 260 having an outer circumferential surface, which may include a textured or knurled portion 238 and indicia 262 for indicating the direction of axial movement required to release the locking collar assembly 230. The textured or knurled portion 238 may be formed in any known manner, such as milling. The indicia 262 may be engraved on the collar 260 by tooling or laser engraving, or may physically applied by ink, or paint or any other suitable method of marking. Additionally, the indicia 262 may be a separate paper or plastic, shaped or color coded, article that may be adhesively attached to the collar 260 in a known manner.

The annular collar 260 further includes distal and proximal inner circumferential surfaces that are separated at distal and proximal right angles by a circumferential bearing engaging surface 264. The distal right angle portion forms a distal snap ring engaging surface 266 for selectively engaging the distal snap ring 232. The proximal right angle portion forms a spring member engaging surface 268 for engaging the spring 236.

The function of the collar is apparent, and best shown in FIG. 2G, where the telescoping handle is shown with the outer sleeve 220 in position on the main shank 214 in an unlocked and partially extended position. The bearing members 234, illustrated as four ball bearing members, ride within the clearance holes 226 in engagement with the outer circumferential surface of the main shank 214, and retained within the clearance holes by the annular collar 260.

In the unextended and locked position shown in FIG. 2A, the bearing members 234 are received within the distal groove 240, and are retained within the grooves 240 via engagement with the bearing member engaging surface 264 of the annular collar 260. The spring member 236 biases the annular collar 260 in this position such that the distal snap ring engaging surface 266 engages the distal snap ring 232.

In order to release the outer sleeve 220 from being axially locked in engagement with the main shank 214, a user moves the annular collar 260 against the biasing force of the spring member 236 towards the proximal end of the outer sleeve 220. As the annular collar 260 is moved away from engagement with the distal snap ring 232, the bearing member engaging surface 264 moves out of engagement with the bearing members 234, as shown in FIG. 2G.

Once the bearing member engaging surface 264 no longer engages the bearing members 234, the outer sleeve 220 may be axially moved with respect to the main shank 214. As the outer sleeve 220 is moved, the bearing members 234 follow the outer circumference of the main shank 214 and are raised within the clearance holes 226 above the outer circumference of the outer sleeve 220 and may engage the distal inner circumferential surface of the annular collar 260. When the spring member 236 is fully compressed, the bearing members 234 are still engaged by the distal inner circumferential surface of the annular collar 260 such that they cannot be removed from the clearance holes 226.

Once the bearing members 234 are removed from the groove 240, the outer sleeve 220 is axially movable with respect to the main shank 214 until the bearing members are received within another, or the same, groove 240, and the annular collar 260 is positioned such that the distal snap ring engaging surface 266 engages the distal snap ring 232. In this manner, the outer sleeve 220 can be axially locked in specific positions along the main shank 214 that corresponds to each position locking groove 240.

In order to maintain the outer sleeve 220 around the main shank 214, a retaining assembly 250 is provided at the proximal end of the main shank 214, as shown in FIGS. 2C and 2D. The retaining assembly may include a distal retaining washer 254 and a proximal retaining washer 256, each having a bore therethrough for receiving a threaded screw or bolt 252 that threadingly engages the threaded hole 258 in the proximal end of the main shank 214.

The retaining washers 254, 256 have the same shape and size outer circumference as the main shank 214, and may have any suitable width, for example ⅛". Thus, once the outer sleeve 220 is positioned on the main shank 214 with the guide pin 224 within the guide groove 216, the retaining assembly 250 may be attached to the main shank 214 via the threaded screw or bolt 252. In this manner the guide pin 224 is retained within the guide groove 216 by the distal retaining washer 254, and thus, the outer sleeve 220 is retained on the main shank 214.

In order to prevent the guide pin 224 from becoming damaged, such as by mushrooming, by contacting the distal washer 254, the distal washer can be made from a softer material than the proximal washer 256. For example, the proximal washer 256 may be made from a metal, such as steel, and the distal washer 254 may be made from a plastic, such as nylon.

Similarly as discussed above, the outer circumferential shape of the main shank 214 and the inner circumferential shape of the outer sleeve 220 are complementary sized and shaped. A clearance space exists between the outer circumferential surface of the main shank 214 and the inner circumferential surface of the outer sleeve 220, such that the outer sleeve 220 may freely move in the axial direction, but may have little or no rotational movement about the distal and proximal ends. Additionally, with the exception of the guide groove 216, the locking grooves 240, and the guide pin 224, the outer circumferential surface of the main shank 214 and the inner circumferential surface of the outer sleeve 220 have a constant size and shape. While, as illustrated, each circumferential shape is circular, any suitable shape, such as those illustrated in FIGS. 8A-E or discussed above, may be used.

Of course, the structures and materials disclosed are exemplary, and any suitable structures or materials that would be apparent to a skilled artisan may be used. For example, the locking grooves 240 may instead be detents for receiving the bearing members 234.

Also, the number and shape of the bearing members 234 may be varied. For example, one, two, three, or any suitable number of bearing members 234 may be used. Further, while the bearing members 234 are shown as ball bearings, other shapes, such as rods or pins may be utilized.

While a screw 252 is illustrated as part of the retaining portion 250, a bolt or any other suitable connection may be used. Further, if it is desired to permanently keep the outer sleeve 220 retained on the main shank 214, the retaining washers may be adhesively, or otherwise permanently attached to the distal end of the main shank 214 in any known manner.

As an alternative to the proximal snap ring 232 received in the groove 228, a raised structure may be integrally formed with the outer sleeve 220. The raised structure may be an annular structure extending around the entire outer circumferential surface of the outer sleeve 220, or a segmented structure. Any suitable structure should form a surface to engage the spring member 236.

D. Detailed Description of a Third Embodiment

A third embodiment, similar to the second embodiment, of a telescoping handle incorporated with a tool head is disclosed in FIGS. 3A-G. In accordance with this embodiment, a tool 300 includes a main shank 314 having a tool assembly 310 located at one end. The tool assembly 310 may include a tool head portion 312 such as a ratchet head of the type previously discussed, or any other suitable tool head. The end of the main shank 314 that has the tool head portion located thereon is defined as the distal end of the main shank 314. The opposing end of the main shank 314 is defined as the proximal end.

Figure 3A:
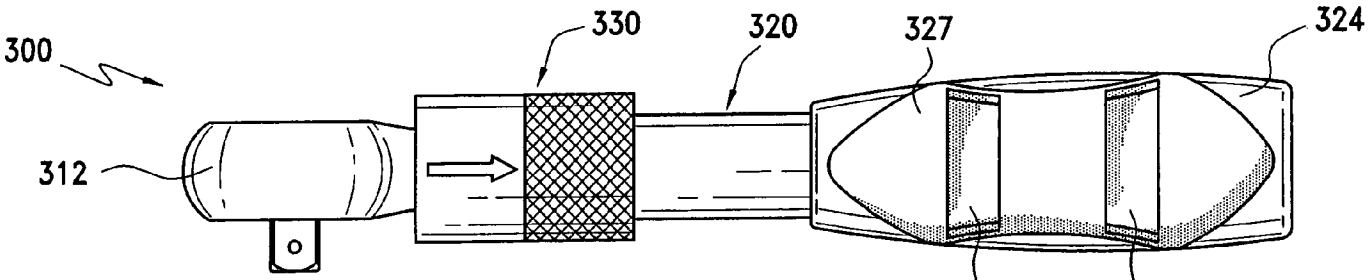
FIG. 3A is a side elevation view of an embodiment of a telescoping handle with a generic ergonomic handgrip, in combination with a tool head, in an unextended position.
Figure 3B:
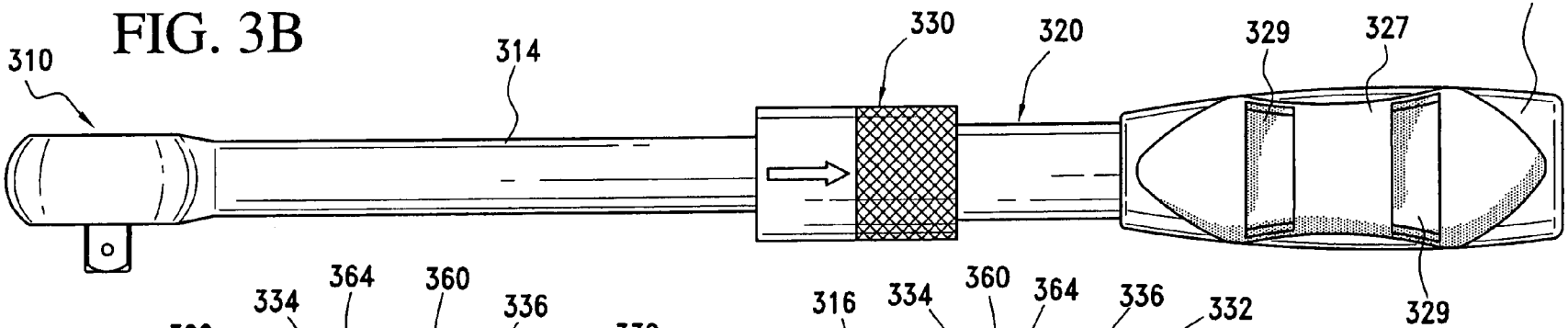
FIG. 3B is a side elevational view of the embodiment of FIG. 3A in an extended position.
Figure 3G:
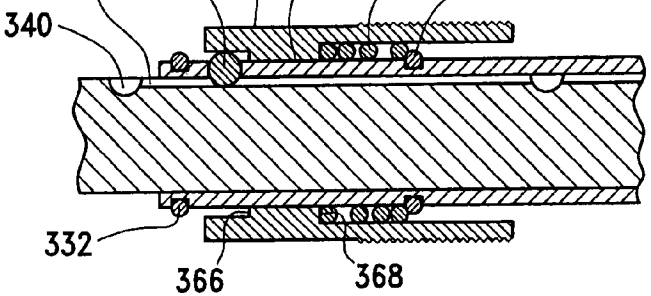
FIG. 3G is a partial cross-sectional view of the annular locking collar, outer sleeve and main shank of the embodiment of FIG. 3A shown in an unlocked position.
Figure 3F:
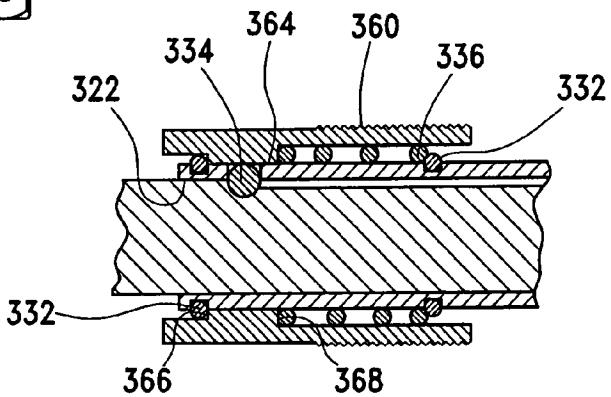
FIG. 3F is a partial cross-sectional view of the annular locking collar, outer sleeve and main shank of the embodiment of FIG. 3A shown in a locked position.
Figures 3C, 3D, 3E:
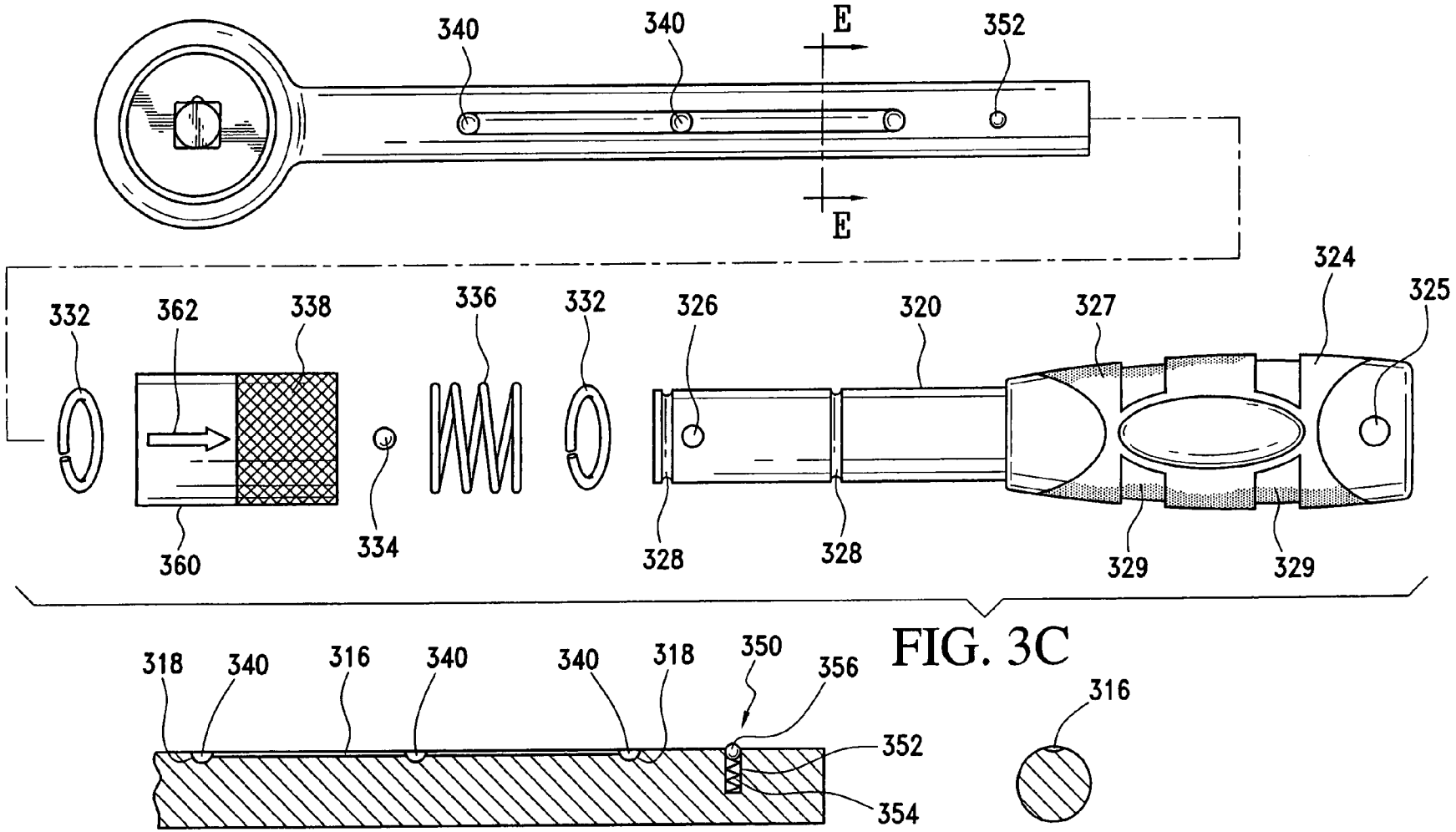
FIG. 3C is an exploded view of the embodiment of FIG. 3A.
FIG. 3D is a partial cross-sectional view of the main shank of the embodiment of FIG. 3A.
FIG. 3E is a cross-sectional view of the main shank of the embodiment of FIG. 3A along line E-E in FIG. 3C.

In this embodiment the proximal end of the main shank 314, as shown in FIG. 3D, may include a retaining and guiding assembly 350 which may include a radial bore 352 to receive a spring member 354 for biasing a bearing member 356 to engage an inner circumferential surface of the outer sleeve 320, as discussed below.

The outer circumferential surface of the main shank 314 includes a guide groove 316 having both distal and proximal terminal guide stops 318. The guide groove 316 of this embodiment may have similar characteristics as the guide groove 116 of the first embodiment, and may be formed in the same manner.

The outer circumferential surface of the main shank 314 also includes locking mechanisms in the shape of locking recesses or detents 340 that are formed within the guide groove 316. As illustrated, three position locking detents 340 are shown, one near the distal end of the main shank 314, one near the proximal end of the main shank 314, and one between the distal and proximal detents. However, any number of detents 340, including a single detent, may be implemented. The number of detents 340 used is the number of distinct locked positions for the telescoping handle, as will be discussed in more detail below. Also as illustrated, the distal and proximal detents 340 define the distal and proximal terminal guide stops 318.

In this embodiment, as best seen in FIGS. 3F and 3G, the telescoping handle includes an outer sleeve 320 that has distal and proximal ends and a bore 322 running therethrough that is defined by an inner circumferential surface. The outer sleeve 320 may include an ergonomic grip 324 that has a hole 325 therethrough for hanging the tool 300 on a hook. As illustrated, the grip 324 has a generalized shape. A skilled artisan, however, will recognize that any suitable shape or size grip may be used. For example, the grip 324 may have flared distal and proximal ends to help prevent the user's hand from sliding off of the grip.

The grip 324 may include a relatively hard base plastic affixed to the outer sleeve 320 in any suitable manner, such as a frictional fit, threading, or via adhesive. The grip 324 may further have a softer more compliant plastic or gel insert 327 formed around the base plastic to provide for a more comfortable gripping surface. The softer, more compliant plastic or gel insert 327 may be connected to the grip 324 in any suitable manner. For example, the insert 327 may be injection molded simultaneously with the grip 324, or molded onto a preformed grip 324. Alternatively, the insert 327 and grip 324 may be formed separately, and later connected via adhesive or bonding in a known manner.

The grip 324 may also have other grip enhancing features, such as friction ridges, indentations or other designs to increase the friction between the user's hand and the grip 324 so that during use the user's hand does not slip off of the grip 324. For example, recesses or indentations 329 may be provided in the insert 327. Of course, similar structural features may be provided to the harder base plastic.

The outer sleeve 320 also includes two axially spaced snap ring retaining circumferential grooves 328 located near the distal end of the outer sleeve 320. The outer sleeve 320 also includes a clearance hole 326 for receiving a bearing member 334 therein. Snap or retainer rings 332 are positioned within the grooves 328 in order to retain a locking and release collar assembly 330 in position on the outer sleeve 320, as discussed above in section C. A spring member 336 is received on the outer sleeve 320 between the proximal snap ring 332 and the locking and release collar assembly 330 in order to bias the annular locking collar towards the distal end of the outer sleeve 320. As discussed above in section C, this position of the annular locking collar allows the outer sleeve 320 to be axially locked with respect to the main shank 314.

The locking and release collar assembly 330 may be of the same design as discussed above with respect to the second embodiment and may include an annular collar 360 having an outer circumferential surface, which may include a textured or knurled portion 338 and indicia 362 for indicating the direction of axial movement required to release the locking collar assembly 330. The annular collar 360 further includes distal and proximal inner circumferential surfaces that are separated at right angles by a circumferential bearing engaging surface 364. The distal right angle portion forms a distal snap ring engaging surface 366 for selectively engaging the distal snap ring 332. The proximal right angle portion forms spring member engaging surface 368 for engaging the spring 336.

The function of the collar is the same as discussed above in section C, and is best shown in FIGS. 3F and 3G, where the telescoping handle is shown in a locked and unlocked position respectively. In this embodiment, the bearing member 334 serves both the function of locking the outer sleeve 320 from axial movement and locking the outer sleeve 320 from rotation, similarly to the guide pins of previous embodiments.

As with the second embodiment, the bearing member 334, illustrated as a ball bearing member, rides within the clearance hole 326, but in engagement with the guide groove 316 of the main shank 314, as opposed to the outer circumferential surface area of the main shank 314, and is retained within the clearance hole by the annular collar 360, as previously discussed.

The manner in which the annular collar 360 engages the bearing member 334 is fully discussed above in section C. A difference between the second embodiment and this embodiment is that when the outer sleeve 320 is in an unlocked position, the bearing member 334 is maintained in engagement with the guide groove 316 in order to perform the function of the guide pin of the previous embodiments.

Similarly as discussed above, the outer circumferential shape of the main shank 314 and the inner circumferential shape of the outer sleeve 320 are complementary sized and shaped. A clearance space exists between the outer circumferential surface of the main shank 314 and the inner circumferential surface of the outer sleeve 320, such that the outer sleeve 320 may freely move in the axial direction, but may have little or no rotational movement about the distal and proximal ends.

Additionally, with the exception of the guide groove 316, and the detents 340, the outer circumferential surface of the main shank 314 and the inner circumferential surface of the outer sleeve 320 have a constant size and shape. While, as illustrated, each circumferential shape is circular, any suitable shape, such as those illustrated in FIGS. 8A-E or discussed above, may be used. If a non-circular shape is utilized, the shape itself aids in preventing relative rotation between the main shank 314 and the outer sleeve 320.

The retaining and guiding assembly 350 provides smooth relative motion, with reduced binding, between the outer sleeve 320 and the main shaft 314. The guiding assembly 350, by providing a bearing member 356 that is biased towards engagement with the inner circumferential surface area of the outer sleeve 320, in combination with the bearing member 334, provides two sliding/rolling contact points between the outer sleeve 320 and the main shank 314 so that the clearance space between the outer sleeve 320 and the main shank 314 is maintained, and binding is prevented.

Of course, the structures and materials disclosed are exemplary, and any suitable structures or materials that would be apparent to a skilled artisan may be used. The number and shape of the bearing members 334 and guide grooves 316 may be varied. For example, two or more bearing members 334 and two or more guide grooves 316 may be used. Further, while the bearing members 334 are shown as ball bearings, other shapes, such as rods or pins may be utilized.

E. Detailed Description of a Fourth Embodiment

Figures 4, 5A, 5B, 5C, 5D:
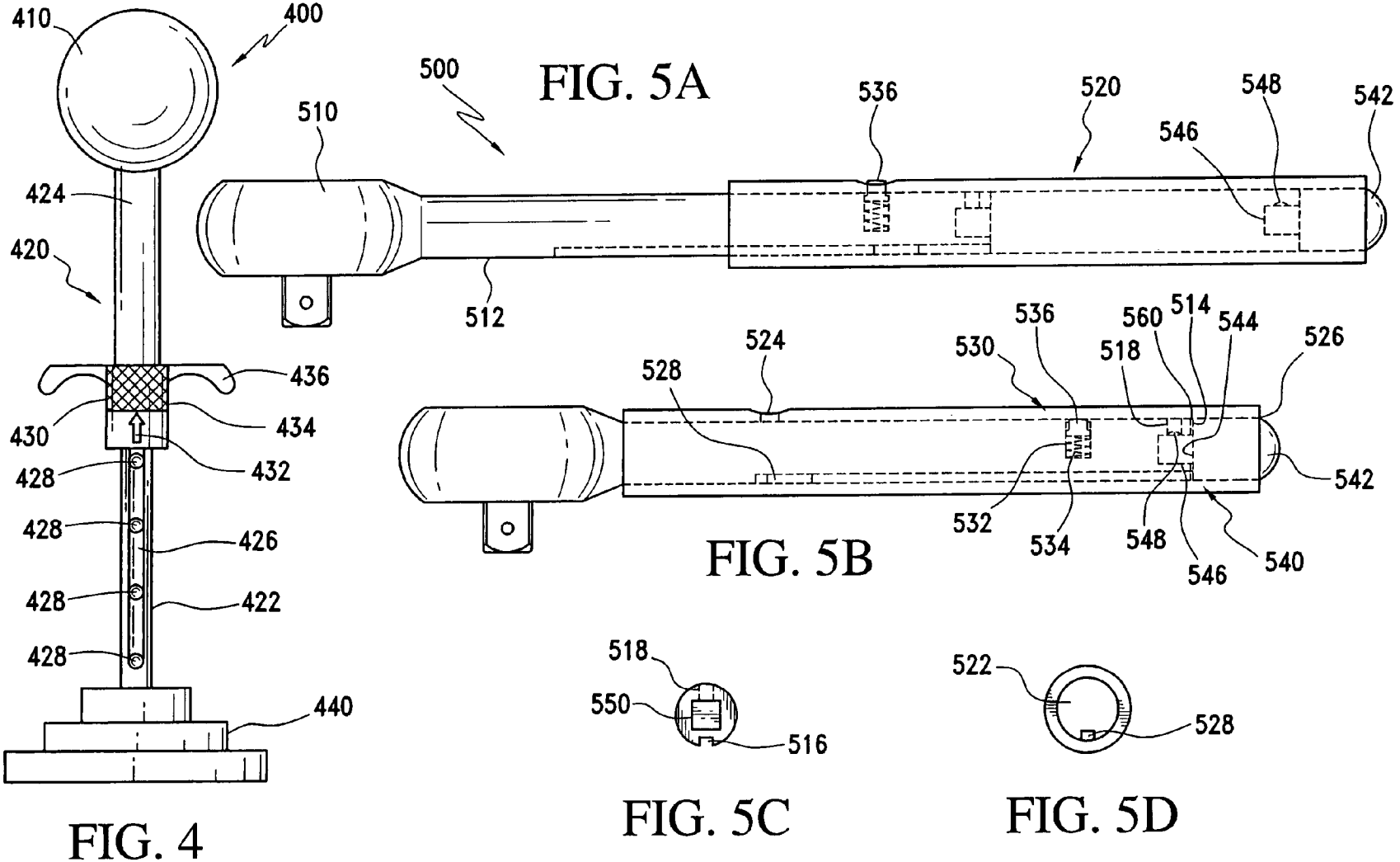
FIG. 4 is side view of an embodiment of a telescoping handle in combination with a base for attachment to a gear shifting mechanism.
FIG. 5A is a side view of an embodiment of a telescoping handle, in combination with a tool head, in an extended position.
FIG. 5B is a side view of the embodiment of FIG. 5A in an unextended position.
FIG. 5C is an end view of the main shank of the embodiment of FIG. 5A.
FIG. 5D is an end view of the outer sleeve of the embodiment of FIG. 5A.

A fourth embodiment of a telescoping handle incorporated with a tool is disclosed in FIG. 4. In accordance with this embodiment, a gear shifter 400 is disclosed having a telescoping gear shift lever 420. The gear shifter includes an ergonomic handle or gear shift knob 410 affixed in any suitable manner, such as press fit, threading, or adhesively, to an outer sleeve 424, similar to outer sleeves previously discussed.

The outer sleeve 424 is connected in a manner similar to those discussed above to a main shank 422 that includes a base 440 for being connected to a gear selection mechanism, for example a transmission for an automobile or truck. This embodiment includes a locking structure that is the same as the locking structure of the third embodiment and includes a guide groove 426 formed in the main shank 422 for engaging a bearing member that is retained by a locking collar 430.

The guide groove 426 includes locking recesses or detents 428 that are of the same design as those in the third embodiment. The locking collar 430 functions in exactly the same manner as the locking collar of the third embodiment in order to selectively lock and release the outer sleeve 424 for extension and shortening.

The locking collar 430 may include a knurled portion 434 and indicia 432 indicating the direction that the collar must be axially moved in order to release the outer sleeve 424 for axial movement. In a variation from the third embodiment, the locking collar 430 may include extensions 436 which define finger grips, which aid in moving the locking collar 430 axially to release the outer sleeve 424 for relative movement.

F. Detailed Description of a Fifth Embodiment

A fifth embodiment of a telescoping handle incorporated with a tool is disclosed in FIGS. 5A-D. In accordance with this embodiment, a tool 500 includes a main shank 512 having a tool head portion 510 located at one end. The tool head 510 may be of any suitable type such as a ratchet head of the type previously discussed, or any other suitable tool head. The end of the main shank 512 that has the tool head portion located thereon is defined as the distal end of the main shank 512. The opposing end of the main shank 512 is defined as the proximal end, and defines a terminal face 514. In this embodiment the terminal face 514 of the proximal end of the main shank 512, as shown in FIG. 5C, may include a rectangular bore 550 to receive a second locking and release mechanism 540 as will be further discussed below.

The outer circumferential surface of the main shank 512 includes a guide groove 516 having a distal terminal guide stop. The guide groove 516 of this embodiment may have similar characteristics as the guide groove 116 of the first embodiment, and may be formed in the same manner.

The outer circumferential surface of the main shank 512 may also include a first locking mechanism 530 located near the proximal end of the main shank 512 that is similar in form to the retaining and guiding assembly 350. The first locking mechanism 530 includes a radial bore 532 for receiving a spring member 534 and a locking button 536. The locking button 536 may include an annular flange, and the edges of the radial bore 532 may be indented slightly to retain the locking button 536 within the radial bore 532, as is recognized by a skilled artisan. The manner in which the first locking mechanism functions will be discussed further below.

The outer circumferential surface of the main shank 512 may also include a hole or recess 518 for engaging with the second locking mechanism 540, as will be discussed in detail below.

Similar to previous embodiments, the tool 500 includes an outer sleeve 520 engaging the main shank 512 in a manner such as those previously discussed. The outer sleeve 520 includes a bore 522 defined by an inner circumferential surface, as in previous embodiments. The outer sleeve 520 is provided with a guide pin 528, such as those previously discussed, for engaging the guide groove 516 in manner as discussed above.

Near a distal end of the outer sleeve 520, a recessed button hole 524 is provided to selectively engage the locking button 536 in order to selectively lock the relative axial movement of the outer sleeve 520, as will be discussed below. The proximal end 526 of the outer sleeve 520 is open to receive the second locking and release mechanism 540.

The second locking and release mechanism 540 may be in the form of a standard socket release mechanism and include a release pushbutton 542 having a terminal face 544 and an extending portion 546 that extends into the receiving portion 550 when the telescoping handle is in the unextended position, such that a ball bearing portion 548 will engage the hole or recess 518 to lock the telescoping handle in the unextended position. In order to prevent damage to second locking and release mechanism a clearance space 560 is provided between the terminal face 514 of the main shank 512 and the terminal face 544 of the release pushbutton.

The second locking mechanism 540 may be secured in the open end 526 of the outer sleeve 520, by set screws, steel pins, press fitting, welding, or any other suitable connection mechanism, as will be recognized by a skilled artisan.

As shown in FIG. 5B, the tool 500 is shown in the locked and unextended position. The ball bearing 548 of the second locking and releasing mechanism 540 is in engagement with the bore or recess 518 in the main shank 512. In this position, the inner circumferential surface of the outer sleeve 520, engages the locking button 536 of the first locking and releasing mechanism 530, such that the locking button is retained within the radial bore 532.

A user may press the release button 542 in order to disengage the ball bearing 548 from the bore or recess 518, in a manner recognized by a skilled artisan as in standard socket release mechanisms. Once the ball bearing 548 is disengaged from the bore or recess 518, the outer sleeve 520 may move axially with respect to the main shank 512, but due to the guide pin 528 engaging the guide groove 516, little to no relative rotation exists between the outer sleeve 520 and the main shank 512. The outer sleeve 520 may be moved axially towards the proximal end of the main shaft 512 until the recessed button hole 524 is aligned with the biased locking button 536. At this point, the locking button 536 is extended through the recessed button hole 524 in order to lock the outer sleeve 520 in position on the main shank 512.

In order to release the telescoping handle from this locked position, a user presses against the biased locking button 536 and slides the outer sleeve 520 over the button 536 such that the inner circumferential surface of the outer sleeve 520 engages the button 536 to retain the button 536 within the radial bore 532. Thus, the outer sleeve 520 is free to move axially on the main shaft 512.

As previously discussed, the disclosed structure and materials are merely exemplary, and numerous other configurations may be used. For example, additional biased locking buttons may be provided in order to define additional locked positions for the telescoping handle.

G. Detailed Description of a Sixth Embodiment

Figures 6A, 6B, 6C:
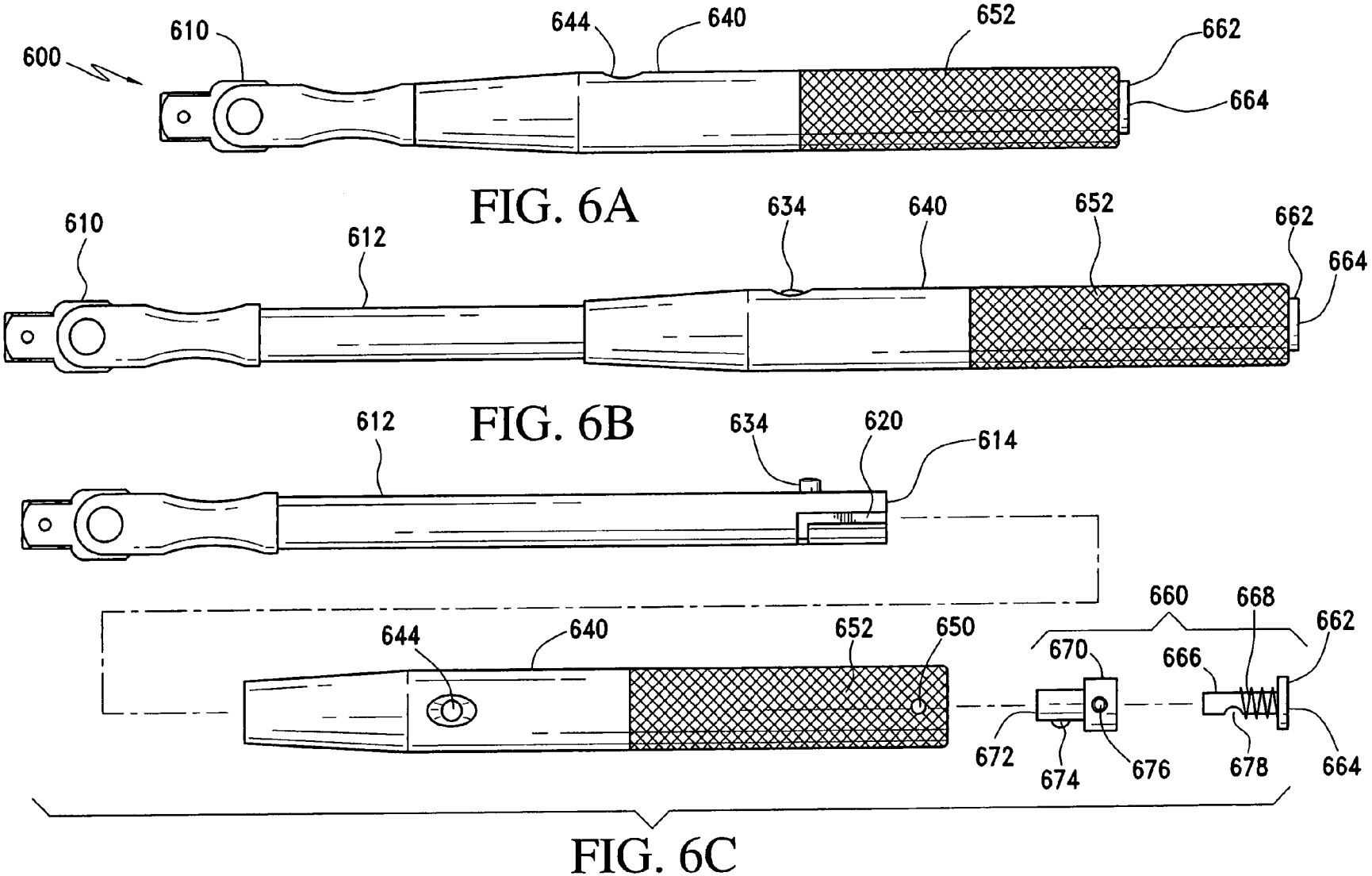
FIG. 6A is a side view of an embodiment of a telescoping handle, in combination with a tool head, shown in a locked and unextended position.
FIG. 6B is a side view of the embodiment of FIG. 6A, shown in an extended and locked position.
FIG. 6C is an exploded view of the embodiment of FIG. 6A.
Figure 6E:
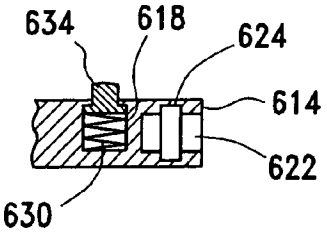
FIG. 6E is a partial cross-sectional view of the first locking mechanism of the embodiment of FIG. 6A.
Figure 6D:
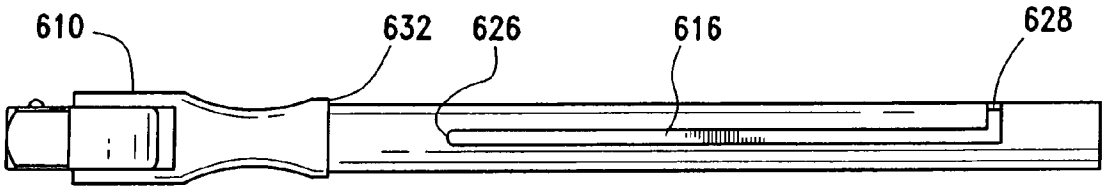
FIG. 6D is a bottom view of the main shank of the embodiment of FIG. 6A.
Figure 6F:
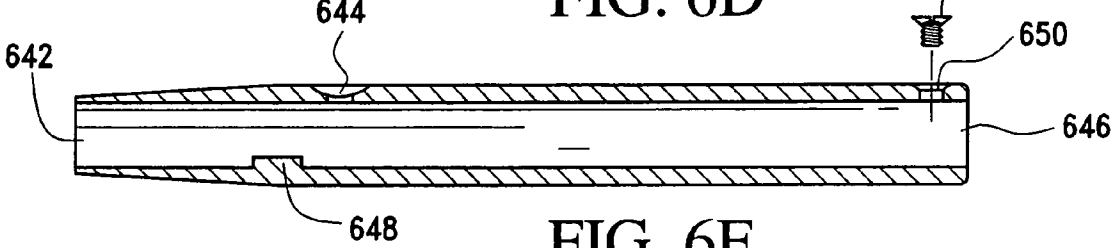
FIG. 6F is a cross-sectional view of the outer sleeve of the embodiment of FIG. 6A.
Figure 8C:
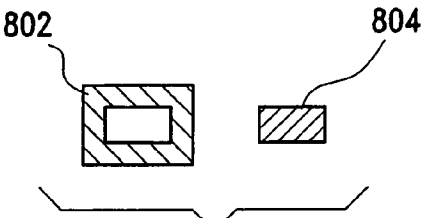
FIGS. 8A-E show exemplary different shapes that the circumferential surfaces of the embodiments of FIGS. 1-7 may have.
Figure 8B:
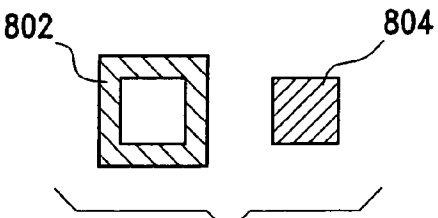
Figure 8E:
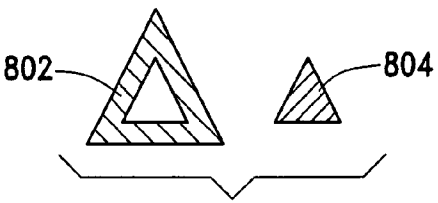
Figure 8A:
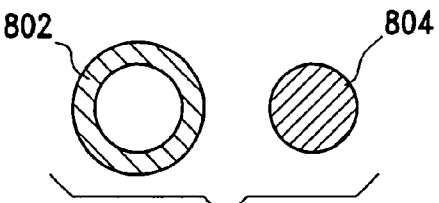
Figure 8D:
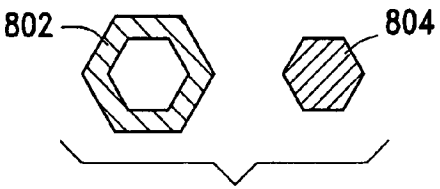

A sixth embodiment of a telescoping handle incorporated with a tool is disclosed in FIGS. 6A-F. In accordance with this embodiment, a tool 600 includes a main shank 612 having a tool head portion 610 located at one end. The tool head 610 may be of any suitable type such as a ratchet head of the type previously discussed, or any other suitable tool head. The end of the main shank 612 that has the tool head portion located thereon is defined as the distal end of the main shank 612. The opposing end of the main shank 612 is defined as the proximal end, and defines a terminal face 614. In this embodiment the terminal face 614 of the proximal end of the main shank 612, as shown in FIG. 6E, may include a circular bore 622 with an annular locking channel 624 therein to receive a second locking and release mechanism 660 as will be further discussed below.

The outer circumferential surface of the main shank 612 includes a guide groove 616 having a distal terminal guide stop 626. The guide groove 616 of this embodiment may have similar characteristics as the guide groove 116 of the first embodiment, and may be formed in the same manner. The guide groove 616 extends along a portion of the outer circumferential surface of the main shank 612 from a position near the distal end of the main shank 612 to a position near the proximal end of the main shank 612. At the proximal end of the guide groove 616 the guide groove 616 intersects with a partially circumferentially extending connecting channel 628 which further intersects with a second axially extending bore or dismantling channel 620 that extends to the proximal end of the main shank 612. The function of the dismantling channel 620 will be further discussed below.

The outer circumferential surface of the main shank 612 may also include a first locking mechanism located near the proximal end of the main shank 612 that is similar in form to the locking mechanism 530. The first locking mechanism includes a radial bore 618 for receiving a spring member 630 and a locking button 634. The locking button 634 may include an annular flange, and the edges of the radial bore 618 may be indented slightly to retain the locking button 634 within the radial bore 618, as previously discussed. The manner in which the first locking mechanism functions is the same as that discussed above with respect to the fifth embodiment.

The outer circumferential surface of the main shank 612 may also be reduced in size from the tool head portion 610 in order to define a shoulder 632 that serves as a stop for the outer sleeve 640. This stop prevents the telescoping handle from becoming seized in the unextended position if the tool 600 is accidentally dropped onto the tool head 110 or onto the proximal end of the handle.

Similar to the fifth embodiment, the outer sleeve 640 engages the main shank 612 in a manner such as those previously discussed. The outer sleeve 640 includes a bore 642 defined by an inner circumferential surface, as in previous embodiments. The outer sleeve 640 is provided with a guide pin 648, such as those previously discussed, for engaging the guide groove 616 in manner as discussed above. A portion of the outer circumferential surface of the outer sleeve 640 may include a textured or knurled portion 652 in order to improve gripping and handling of the tool 600.

Near a distal end of the outer sleeve 640, a recessed button hole 644 is provided to selectively engage the locking button 634 in order to selectively lock the relative axial movement of the outer sleeve 640, as previously discussed. The proximal end 646 of the outer sleeve 640 is open to receive the second locking and release mechanism 660. The outer sleeve may include a clearance hole 650 to receive a mounting screw 654 to engage a threaded hole 676 in the second locking and release mechanism 660, as will be discussed below.

The second locking and release mechanism 660 may be in a form similar to the standard socket release mechanism and include a release pushbutton 662 having a terminal face 664 and an extending portion 666 that extends into a stepped bore 672 of a fixing collar 670. The pushbutton 662 is biased via a spring member 668 that is received and supported by the stepped bore 672. The extending portion includes a recess 678 to receive a locking ball bearing 674, that protrudes through a portion of the locking collar 670, as shown in FIG. 6C. This structure functions in a manner similar to a standard socket head, as is known to a skilled artisan.

When the telescoping handle is in the unextended position, the ball bearing portion 674 will engage the locking channel 624 to lock the telescoping handle in the unextended position, in a manner similar to that described above with respect to the fifth embodiment.

As shown in FIG. 6A, the tool 600 is shown in the locked and unextended position. The ball bearing 678 of the second locking and releasing mechanism 660 is in engagement with the locking channel 624 in the main shank 612. In this position, the inner circumferential surface of the outer sleeve 640, engages the locking button 634 of the first locking and releasing mechanism, such that the locking button is retained within the radial bore 618.

As previously described, a user may press the release button 662 in order to disengage the ball bearing 678 from the locking channel 624, in a manner recognized by a skilled artisan for use in standard socket release mechanisms. Once the ball bearing 678 is disengaged from the locking channel 624, the outer sleeve 640 may move axially with respect to the main shank 612, but due to the guide pin 648 engaging the guide groove 616, there is little to no relative rotation exists between the outer sleeve 620 and the main shank 612. The outer sleeve 640 may be moved axially towards the proximal end of the main shaft 612 until the recessed button hole 644 is aligned with the biased locking button 634. At this point, the locking button 634 is extended through the recessed button hole 644 in order to lock the outer sleeve 640 in position on the main shank 612.

In order to release the telescoping handle from this locked position, a user presses against the biased locking button 634 and slides the outer sleeve 640 over the button 634 such that the inner circumferential surface of the outer sleeve 640 engages the button 634 to retain the button 634 within the radial bore 618. Thus, the outer sleeve 640 is free to move axially on the main shaft 612.

In order to remove the outer sleeve 640 from the main shank 612, the guide pin 648 must traverse the path defined by the guide groove 616, the connecting channel 628, and the dismantling channel 620. In order to traverse this path a user must perform the following steps.

When the telescoping handle is in the extended and locked position, as shown in FIG. 6B, the user must press the biased locking button 634 and rotate the outer sleeve 640 such that the guide pin 648, engages the connecting channel 628. Once the guide pin 648 reaches the terminal end of the connecting channel 628 that intersects with the dismantling channel 620, the user may slide the outer sleeve 640 from off of the main shank 612. The user reverses the process to replace the outer sleeve 640 onto the main shank 612. Dismantling the outer sleeve 640 from off of the main shank 612 provides the user with the capability to clean sand, dirt, or other grime out of the bore 642 of the outer sleeve 640, and from off of the outer circumferential surface of the main shank 612. Thus, the clearance between the outer sleeve 640 and the main shank 612 may be maintained for smooth sliding between the outer sleeve 640 and the main shank 612, and the risk of damage to the components is reduced.

As previously discussed, the disclosed structure and materials are merely exemplary, and numerous other configurations may be used. For example, additional biased locking buttons may be provided in order to define additional locked positions for the telescoping handle. Further, while a push-button is illustrated, any suitable structure, such as a rotating dial, may be implemented.

H. Detailed Description of a Seventh Embodiment

Figure 7A:
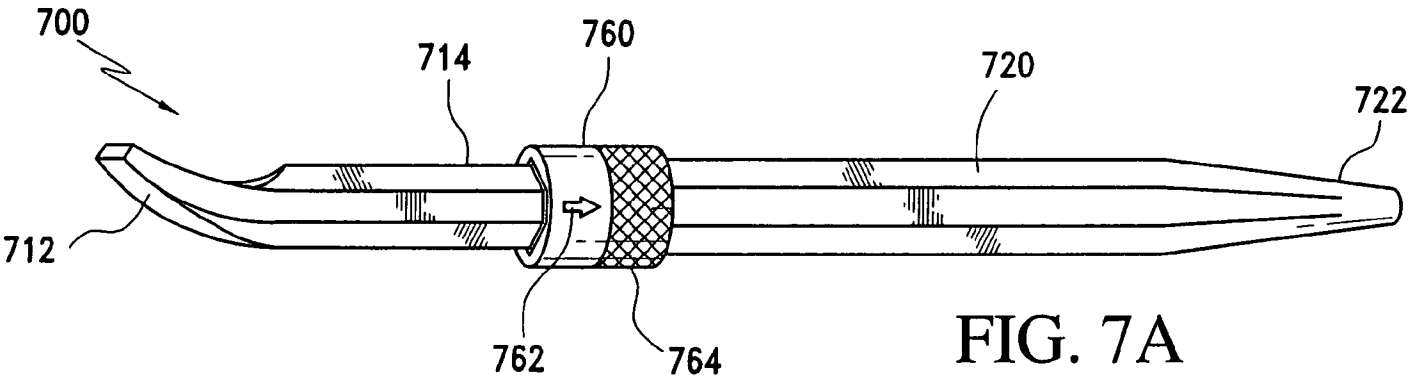
FIG. 7A is a side view of a telescoping handle, in combination with two tool heads, shown in an unextended position.
Figure 7B:
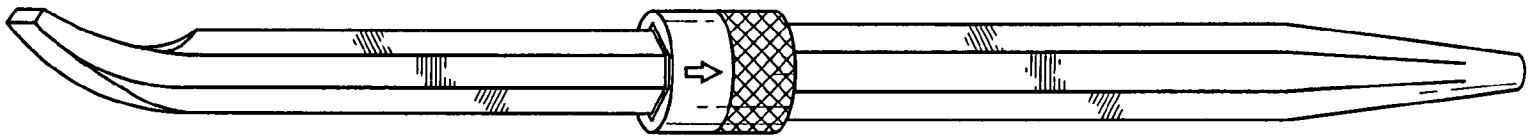
FIG. 7B is a side view of the embodiment of FIG. 7A shown in an extended position.
Figure 7C:
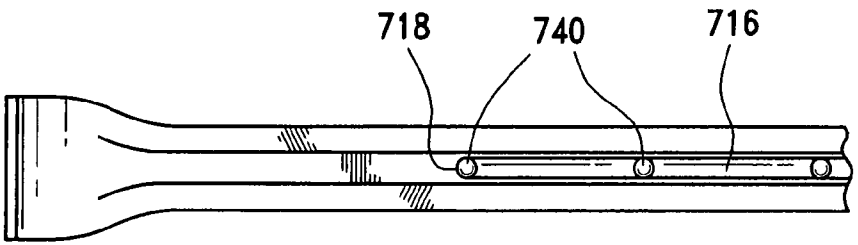
FIG. 7C is a partial top view of the main shank of the embodiment of FIG. 7A showing the guide groove and the detents.

A seventh embodiment of a telescoping handle incorporated with a tool is disclosed in FIGS. 7A-C. In accordance with this embodiment, a tool 700 includes a main shank 714 having a first tool head portion 712 located at the distal end. The first tool head 712 may be of any suitable type such as a crow bar or pry bar, or any other suitable tool head.

A guide groove 716 of the type disclosed with respect to the third embodiment may be provided in the outer circumferential surface of the main shank 714. The guide groove may have at least one terminal guide stop 718, and numerous locking detents or recesses 740, such that the terminal guide stop 718 is formed by a locking detent 740.

The tool 700 is provided with an outer sleeve 720 in the manner of previous embodiments, with the exception that in this embodiment, the proximal end portion of the outer sleeve 720 defines a second tool head portion 722, such as a hole aligning device, wrecking bar, or any other suitable tool.

The tool 700 may include a locking collar 760 with a knurled portion 764 and indicia indicating the direction that the collar 760 should be moved to unlock the telescoping handle, in a manner discussed above with respect to the third embodiment.

The locking collar 760 functions in exactly the same manner as previously discussed with respect to the third embodiment.

The shapes of the outer circumferential surface of the main shank 714 and the inner circumferential surface of the outer sleeve 720 are correspondingly shaped, in a manner previously discussed. As illustrated, the shapes are hexagonal, however, any suitable shape may be used, as previously discussed. For example in FIGS. 8A-E, numerous shapes for the main shank 804 and the outer sleeve 802 are disclosed.

As with all of the collars previously discussed, the internal circumferential surface of the bearing engaging surface of the collar 760 is correspondingly sized and shaped to allow the collar 760 to slide axially on the outer sleeve 720. For example, in this embodiment, the internal circumferential surface of the bearing engaging surface of collar 760 is hexagonally shaped. This is likewise true for all of the discussed embodiments, that the internal circumferential surface of the bearing engaging surface of the collar is correspondingly sized and shaped to allow the collar to slide axially on the outer sleeve.

I. Detailed Description of an Eighth Embodiment

Telescoping handles of the types already disclosed may also be used in numerous applications which require repetitive cranking or rotation. As previously discussed, the length of the handle determines the amount of torque or leverage that will be applied to a work piece. A winch is designed to transfer a pulling force to many different types of items which vary greatly in mass. The amount of effort required by a user to rotate a fixed length handle of a winch can vary with the mass of the object being winched. Thus, it would be beneficial to provide cranking tools, such as winches, windlasses, capstans (straight version), landing gear for trailers (transport, boat, tractor-trailer or semitruck), stands for farm implements, and doors for grain bins such as gravity boxes or silos (grain elevators), with a telescoping handle. A telescoping handle would be advantageous for any tool dealing with grain or grain storage, since grain dust is explosive and therefore limits the use of electric or other types of motors. Also, as previously discussed, a fixed length handle requires certain clearance requirements, whereas the disclosed telescoping handle may be collapsed into a shorter length when not being used.

Figures 9A, 9B:
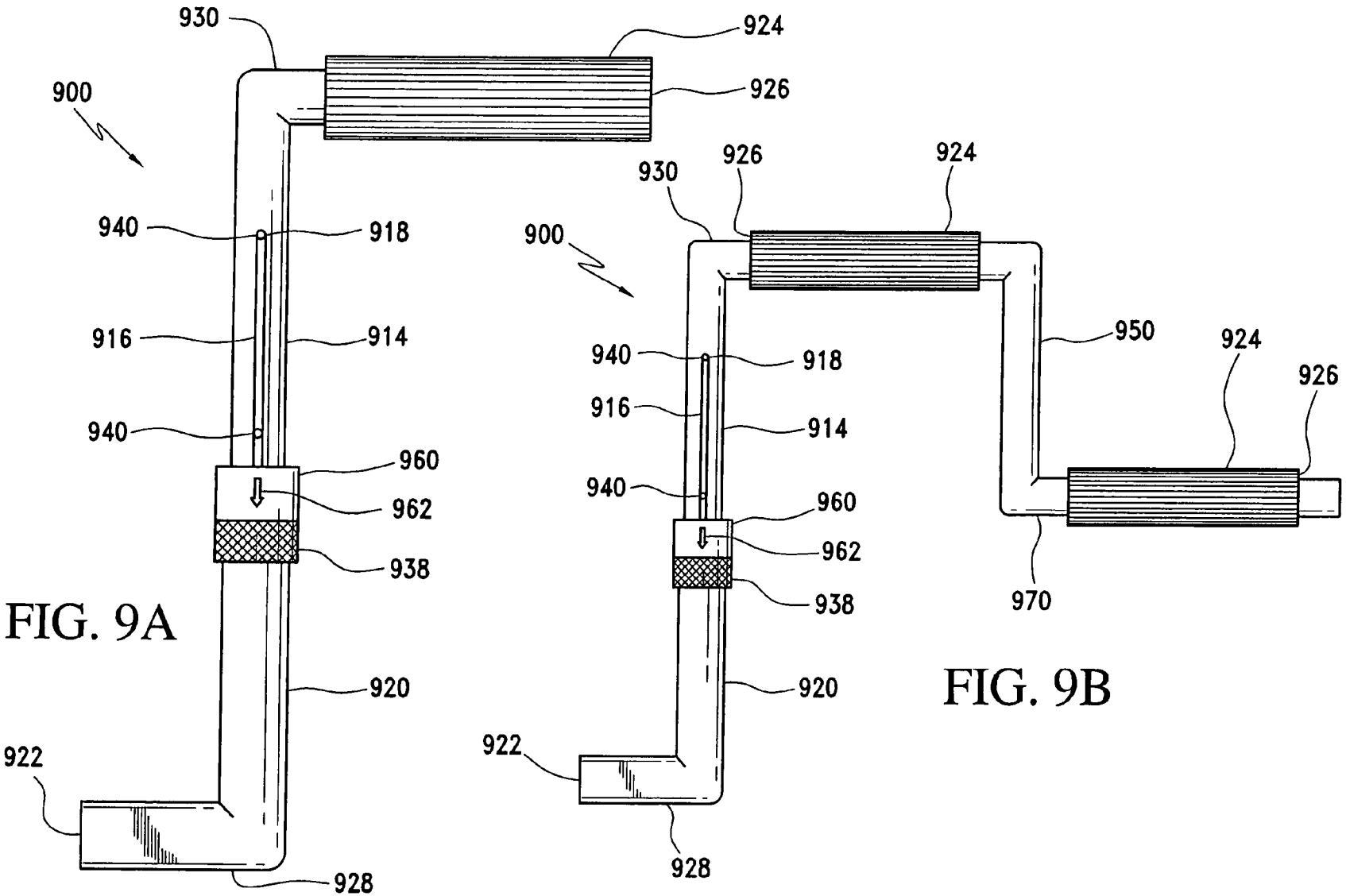
FIG. 9A is a front view of a telescoping handle for use with winches, windlasses, capstans and other crank type devices.
FIG. 9B is a front view of an alternative telescoping handle for use with winches, windlasses, capstans and other crank type devices.

An exemplary telescoping handle for use with any cranking type tool is shown in FIG. 9A. This embodiment may use any of the previous structures described for providing a telescoping handle. As illustrated, the tool 900 utilizes a main shank 914 and a complementary shaped outer sleeve 920, such as those previously described. In order to transfer a rotational motion to the cranking tool, the main shank has an angled portion 930 and the outer sleeve has an angled portion 928. As illustrated the angled portions 928, 930 are shown being oriented at right angles to the respective handle portions. Of course, it will be recognized that other angles may be used in place of, or in addition to, the illustrated right angles.

In contrast to previous embodiments, a tool engaging portion 922 is located in the angled portion 928 at the proximal end of the outer sleeve 920, as opposed to the distal end of the main shank 914. Of course, a skilled artisan will recognize that the tool engaging portion 922 may be located on the main shank 914, as disclosed in the previous embodiments.

The telescoping handle may be detachably connected to any type of crank device, such as a winch, in any known manner. For example one or more set screws may be used to connect the tool engaging portion 922 to the axle of the winch or crank device. Alternatively, removable and replaceable cotter pins may be used to link the tool engaging portion 922 to the axle of the winch or crank device. Of course, any type of bolt or other threaded connection may also be used.

As an alternative, the telescoping handle may be more permanently fixed to the winch or crank device by utilizing a press fitting, welding, bonding, or other known methods of fixation.

The telescoping function of the tool 900 is the same as previously discussed with respect to the third embedment. A guide groove 916 is provided in the outer circumferential surface of the main shank 914 in a manner previously discussed. Locking detents or recesses 940 may be provided in the guide groove 916, or elsewhere along the main shank 914. At least one of the detents 940 defines a terminal guide stop 918 located in at least one end of the guide groove 916.

As previously described, a locking collar 960 may be provided on the outer sleeve 920 in order to lock and release a bearing member within the locking detents or recesses 940. The collar 960 may have a knurled portion 938 to improve gripping and indicia 962 to indicate the direction the locking collar 960 is to be moved in order to allow the telescoping handle of the tool 900 to be extended.

In order to aid the user in rotating or winding the crank type tool, an ergonomic grip 924 may be provided along the angled portion 930. The grip 924 may be a fixed type grip or a loose rotating type grip, as will be recognized by a skilled artisan. The grip may include grip enhancing features 926, such as friction ridges or designs to increase friction between the user's hand and the grip. The grip may also be of the type previously disclosed with respect to the third embodiment.

In order to provide more freedom of movement to the tool 900, in particular when the handle 900 is utilized for landing gear, stands, doors, and other suitable crank type devices, a hinge, joint, or knuckle of conventional design may be provided between the angled portion 928 and the outer sleeve 920 or between the tool engaging portion 922 and an axle of a winch or crank type device. In this manner the tool 900 may be stored flat against the trailer, stand, door, or other device, to reduce inadvertent collisions and catching that typically would occur with a normally protruding crank.

Further, the hinge, joint, or knuckle may include removable connections, such as those described above, in order to allow the telescoping handle to be removed from the winch or crank device when it is not in use.

In a further variation, as shown in FIG. 9B, the tool 900 may be in the form of a speed crank. In this variation there is an additional handle portion 970 provided to aid the user in rotating the axle of a winch or crank device more quickly.

The additional handle portion 970 may be connected to a connecting portion 950 that is connected to the end of the angled portion 930 that is opposed to the end that is connected to the main shank 914. As illustrated, the connections may all be at right angles. Of course, as previously stated, other angles may be utilized instead of, or in addition to the right angles.

The connecting portion 950 may have any desired length, and may be longer or shorter than as shown. In order to increase the effectiveness of the handle 900, the connection portion 950 may have a length such that the handle portion 970 is axially aligned with the axle of the winch or crank device.

In another alternative embodiment, the connecting portion may include a main shank, outer sleeve, and locking collar, as described above with respect to the third embodiment, so that the connecting portion 950 may be extended or shortened in a manner as previously discussed.

The additional handle portion 970 may include another grip 924, as previously described. Both grips 924 may be of the rotating type to allow a user to continuously wind the winch or crank device without having to remove their hands from the grips 924.

As previously discussed, a universal joint, hinge, or knuckle may be provided at the tool connection portion 922 in order to provide multiple axes of rotation for the telescoping handle in order to allow a user to wind the winch or crank device in multiple positions, and to allow the telescoping handle to be oriented with a low profile against the winch or crank device. Also as previously discussed, the universal joint, hinge, or knuckle may include removable connection devices such as set screws or removable cotter pins, so that the telescoping handle may be completely removed when use of the handle is not required.

J. Alternate Embodiments

Numerous alternate embodiments may be envisioned that mix and match various features of the disclosed embodiments or utilize different tool heads known in the art. For example, knurling or ergonomic handles may be provided on any outer sleeve to improve gripping. Further, it will be recognized that the embodiments disclosed herein are applicable to any size or length of tool for use with any size work piece.

Therefore, of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

The skilled artisan will recognize the interchangeability of various features from different embodiments and method steps. In addition to the variations described herein, other known equivalents for each feature can be mixed and matched by one of ordinary skill in this art to construct a telescoping tool in accordance with principles of the present invention.

Although this invention has been disclosed in the context of certain exemplary embodiments and examples, it therefore will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims below.

We claim:

1. A tool having a telescoping handle comprising:

a main shank including a distal operational end, a proximal end, and an outer circumferential surface along the shank between the distal and the proximal ends;

an axial guide groove formed in the outer circumferential surface of the main shank and extending along a portion of the shank from the distal end towards the proximal end, the guide groove including at least one terminal guide stop at an end of the guide groove;

at least one first locking structure formed in the circumferential surface of the main shank and a second locking structure formed in the distal end of the main shank;

an outer sleeve mounted telescopically to the main shank, the sleeve defining distal and proximal ends, an outer circumferential surface, a bore defined by an inner circumferential surface sized and configured to matingly engage the outer circumferential surface of the main shank, a guide pin on the inner circumferential surface for engaging the guide groove, and at least one hole defined through the outer sleeve and positioned near the distal end and configured to engage the first locking structure; and a release mechanism carried by the proximal end of the outer sleeve and configured to engage the second locking structure.

2. A tool according to claim 1, wherein the first locking structure comprises:

a radial bore formed near the proximal end of the main shank;

a spring member positioned within the bore; and a locking button positioned within the bore and biased radially away from the main shank by the spring member, such that when the outer sleeve is placed upon the main shank, the locking button engages the inner circumferential surface of the outer sleeve, or the locking button engages the hole defined through the outer sleeve.

3. A tool according to claim 1, wherein the axial guide groove extends to the proximal end of the main shank.

4. A tool according to claim 1, wherein the axial guide groove extends from a position near the distal end of the main shank to a position near the proximal end of the main shank;

the axial guide groove intersects a partial circumferential connecting channel extending circumferentially around a portion of the main shank; and the partial circumferential connecting channel intersects an axial dismantling channel that extends to the proximal end of the main shank, such that when the outer sleeve is received on the main shank, the guide pin respectively engages the axial dismantling channel, the partial circumferential connecting channel, and the axial guide groove.

5. A tool according to claim 1, wherein the release mechanism comprises:

a button portion having a pressing surface, and an extending shank with a spring member received on the extending shank for biasing the pressing surface in an unactuacted position and a grooved portion formed in the extending shank for receiving a bearing member; and a retaining portion having a stepped axial bore therethrough to receive the extending shank and define an engaging surface for the spring member, a radial hole through which a portion of the bearing member extends to selectively engage the second locking structure, and a threaded hole for receiving a threaded screw that engages a second hole in the outer sleeve portion such that the release mechanism is retained in the proximal end of the outer sleeve.

* * * * *